United States Patent [19]

Kerley

[11] 4,252,007

[45] Feb. 24, 1981

[54] PORTABLE APPLIANCE SECURITY APPARATUS

[75] Inventor: James J. Kerley, Cheverly, Md.

[73] Assignee: The United States of America as represented by the Administrator of the National Aeronautics and Space Administration, Washington, D.C.

[21] Appl. No.: 961,831

[22] Filed: Nov. 17, 1978

[51] Int. Cl.[3] ..... E05B 73/00

[52] U.S. Cl. ..... 70/58

[58] Field of Search ..... 70/57, 58, 63, 62; 248/551, 552, 553

[56] References Cited

U.S. PATENT DOCUMENTS

| | | | |
|---|---|---|---|
| 2,716,882 | 9/1955 | Gill | 70/57 |
| 3,859,826 | 1/1975 | Singer | 70/58 |
| 3,895,768 | 7/1975 | Scheck | 248/553 |
| 3,984,075 | 10/1976 | Bahner | 70/58 |
| 4,123,922 | 11/1978 | Kuenstler | 70/58 |

*Primary Examiner*—Robert L. Wolfe

*Attorney, Agent, or Firm*—Robert D. Marchant; John R. Manning; John O. Tresansky

[57] ABSTRACT

An apparatus for securing a small computer, or other portable appliance, against theft comprises a case having an open back through which the computer is installed or removed. Guide members in the form of slots are formed in a rear portion of opposite walls of the case for receiving a back plate to cover the opening and thereby secure the computer within the case. An opening formed in the top wall of the case exposes the keyboard and display of the computer. The back plate is locked in the closed position by a key-operated plug type lock. The lock is attached to one end of a hold down cable, the opposite end thereof being secured to a desk top or other stationary object. Thus, the lock simultaneously secures the back plate to the case and retains the case to the stationary object.

19 Claims, 6 Drawing Figures

PORTABLE APPLIANCE SECURITY APPARATUS

ORIGIN OF THE INVENTION

The invention described herein was made by an employee of the United States Government, working at the National Aeronautics and Space Administration, and may be manufactured and used by or for the Government for governmental purposes without the payment of any royalties thereon or therefor.

BRIEF SUMMARY OF THE INVENTION

The present invention relates generally to an apparatus for preventing theft of portable appliances, and more particularly, toward a security case into which a small computer is located and which is locked closed and secured to a desk or other stationary object by a hold down cable.

Small hand held electronic calculators and computers have become widely used over the previous few years. Recently, sophisticated electronic calculators have been provided with programming capability and innumerable build-in functions that have greatly increased the practical and financial value of the devices. It is now possible to purchase hand-held computers that are capable of performing thousands of built-in program steps and hundreds of user programmable steps and generating the results either on a visual display or printer.

Because many of the portable computers and sophisticated calculators represent a substantial financial investment, and because there is a particularly large risk of theft associated with these devices due to their small size, it has become necessary to provide protection against theft. Although some manufacturers of computers have provided custom locking devices for particular computer models, there is a need for a security device that is adapted to be used with a wide range of particular computers, calculators and the like.

Some universal appliance hold-down devices have been developed which are adapted to secure typewriters, adding machines or other appliances to a desk. These security devices typically require a locking member to be bonded or otherwise secured to the appliance, the locking member itself being releasably secured to a metal hold-down cable. It is often unsuitable, however, to bond or otherwise permanently secure a locking member to the appliance case both because of aesthetics and because the case itself is generally formed of plastic which can be easily broken. Permanently bonding a locking member to the appliance is particularly unsuitable where the appliance is being displayed for sale.

Accordingly, one object of the present invention is to provide a new and improved apparatus for securing a portable appliance against theft.

Another object is to provide a new and improved securing appliance that is adapted to be used with appliances of various shapes and sizes.

Another object is to provide a new and improved security apparatus that protects an appliance against theft without bonding, puncturing or otherwise damaging the appliance surface.

Yet another object is to provide a new and improved security device for portable appliances that protects the body of the appliance against tampering.

Still another object is to provide a new and improved security apparatus for portable appliances, that retains the appliance within the case.

Briefly, these and other objects are obtained by providing a metal or heavy gauge plastic case for containing a computer or other portable appliance which is secured against theft and is fastened to a desk top or other stationary fixture by a hold-down cable. The case has a configuration corresponding to the configuration of the computer and is formed with an opening to expose the keyboard and display. The rear of the case is open to enable entry therethrough of the computer. The rear opening is covered by a back plate that fits into a pair of guide slots formed on opposite walls of the case. In one embodiment, the slots are formed, respectively, on the top and bottom walls and the back plate is inserted into the case from above. In a second embodiment, the slots are formed on opposite side walls of the case and the back plate is inserted from one side.

One edge of the back plate is formed with a tab having a width that is substantially less than the total width of the back plate. The tab is adapted to extend into one of the guide slots formed in the case to make it impossible for a thief to gain access to the computer by prying the tab. Also formed in the back plate is a cut out portion to expose the power terminals of the computer.

In one embodiment of the back plate, a first aperture is formed therein and a second, corresponding aperture is formed in a rear flange extending outwardly from the case. When the back plate is located through the guide slots, the two apertures are in alignment and a plug type locking member is positioned within the apertures to secure the back plate. The locking member is secured to one end of the hold-down cable, the opposite end being attached to the stationary object. The locking member thus both secures the back plate to the case and retains the case on the stationary object making it impossible to remove the computer. When the locking member is unlocked, the case is released from the hold-down cable and the back plate is simultaneously unlocked from the case enabling removal of the computer.

In another embodiment of the back plate, the tab which extends through the guide slot formed in the case also extends through another corresponding slot formed in the table top or in a special support bracket. A conventional padlock or other locking member is located through an aperture formed in the tab beneath the table top or bracket to secure the computer and casing.

Still other objects and advantages of the present invention will become readily apparent to those skilled in this art from the following detailed description, wherein is shown and described only the preferred embodiments of the invention, simply by way of illustration of the best modes contemplated carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWING

In the drawings where like parts are designated by the same references.

DETAILED DESCRIPTION

Figure 1:
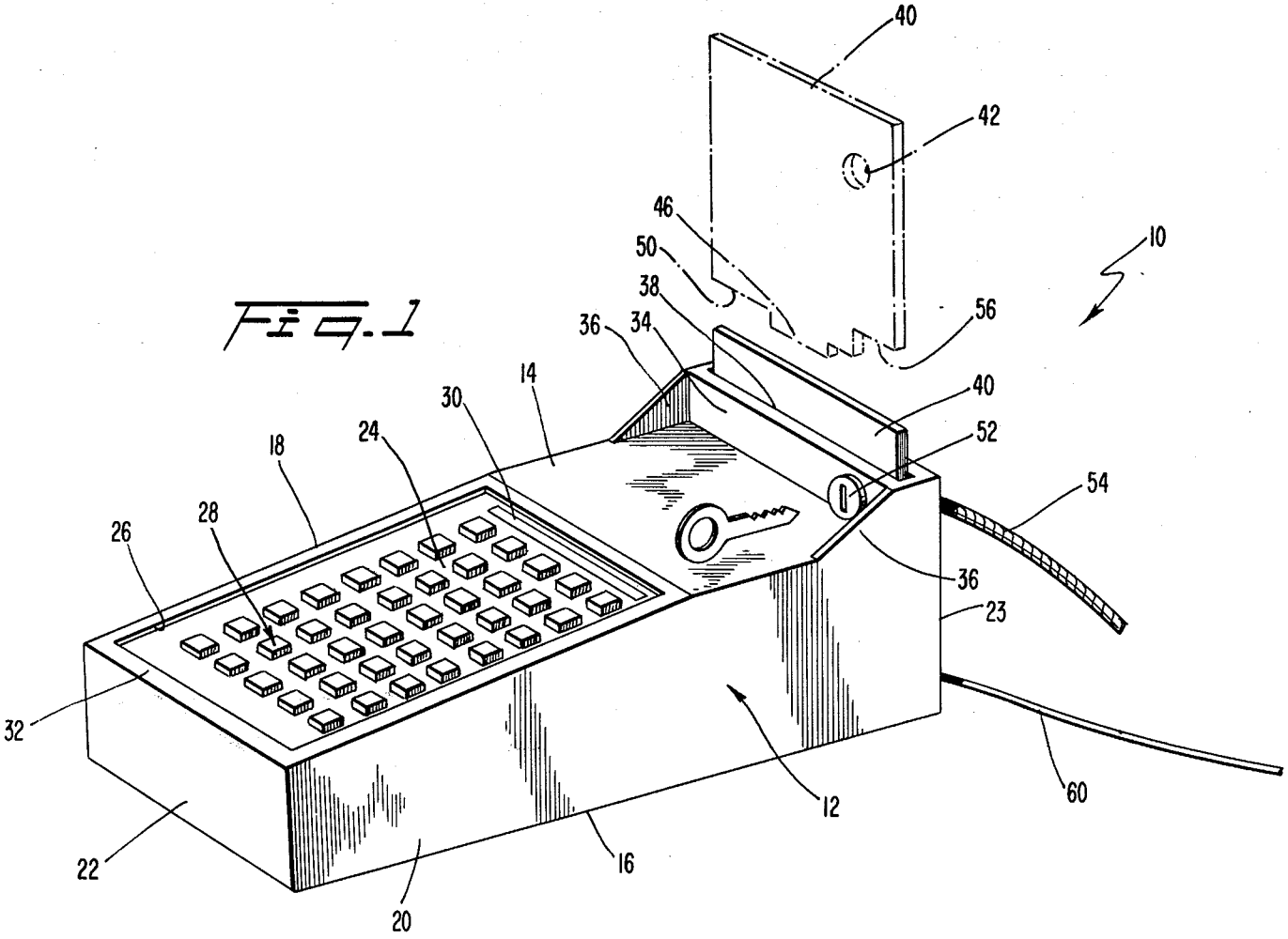
FIG. 1 is a perspective view showing a portable computer located within a security case in accordance with a first embodiment of the invention.
Figure 2:
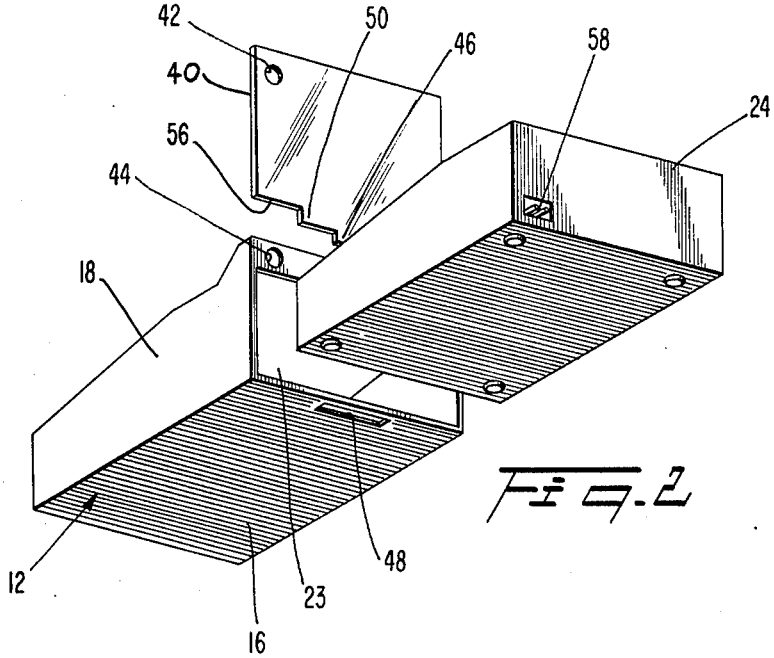
FIG. 2 is a perspective rear view of the first embodiment of the invention illustrating entry or removal of a computer through the back opening of the case.

Referring to FIGS. 1 and 2, a security device 10, in accordance with the invention , comprises a case 12 formed of metal or heavy gauge plastic and defined by a top wall 14, a bottom wall 16, opposite side walls 18 and 20 and a front wall 22. The rear 23 of the case 12 is open to permit access by a small, portable calculator or computer 24. The case 12 has approximately the same configuration and size as the computer 24, and includes an opening 26 formed in top wall 14 to expose the keyboard 28 and display 30 of computer 24. The portion of the top wall 14 defining the keyboard 28 and display opening 26 forms an inwardly extending lip or flange 32 for retaining the computer 24 within the case 12.

A flange 34 extends outwardly from the top wall 14 of casing 12, and is reinforced by side ribs 36. A first slot 38 is formed in flange 34 to receive a back plate 40 also preferably formed of metal or heavy gauge plastic. The back plate 40 has a generally quadralateral shape and is formed with a first aperture 42 positioned to correspond with a second aperture 44 formed in the outwardly extending flange 34. A tab 46 is formed along the lower edge of the back plate 40 and is adapted to be inserted into a corresponding slot 48 formed in bottom wall 16 of the casing 12.

When the back plate 40 is inserted through slots 38, 48, the tab 46 is seated in lower slot 48 with bottom edge 50 located against the inner surface of bottom wall 16. This structure makes it impossible for a thief to gain entry to the case 12 by prying the tab 46. When the back opening 24 is enclosed by the back plate 40, apertures 42 and 44 are in alignment with each other. A key-operated, plug type locking member 52 is inserted in the flange 34 so that it extends through both of the apertures 42 and 44 securing the back plate 40 closed. The locking member 52 is attached to one end of a heavy metal cable 54, the opposite end of the cable being secured to a desk (not shown) or other stationary object.

Back plate 40 has a cut out portion 56 formed therein for exposing a pair of power terminals 58 in the computer 24 so that when the apparatus 10 is assembled, electrical power can be supplied to the terminals 58 from an external power source (not shown). Electrical wires 60 connected to the computer 24 for other purposes such as battery charging or data transferring are also supplied through the cut out portion 56.

Of particular significance to the invention, the locking member 52 provides the dual function of securing back plate 40 to case 12 and securing the case and back plate to the hold-down cable 54. Accordingly, the back plate 40 is locked to the case 12 and to the hold-down cable 54 in a single operation. Similarly, upon unlocking the member 52, the case 12 is released from hold-down cable 54 and the back plate 40 may be removed to obtain access to the computer 24.

Figure 3:
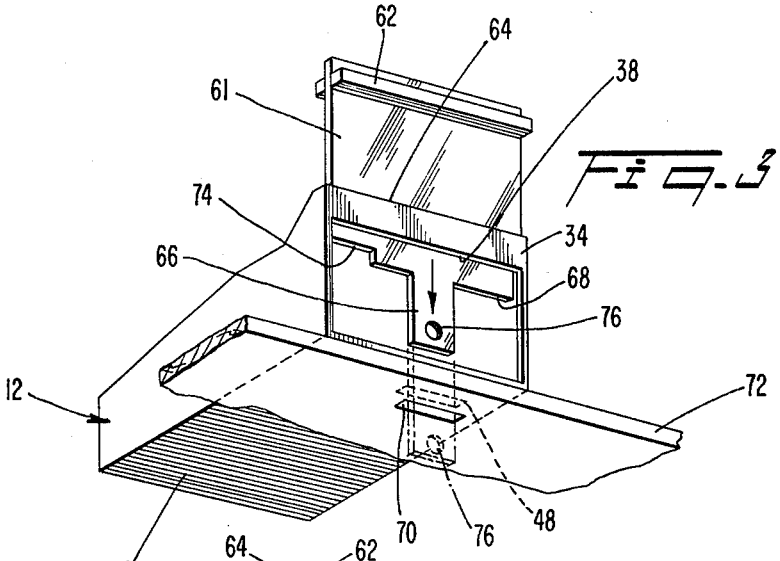
FIG. 3 is a perspective rear view showing a second embodiment of the back plate, in accordance with the invention.
Figure 5:
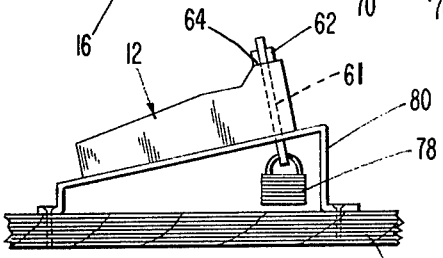
FIG. 5 is a side view showing the security case of FIG. 3 mounted on and secured to a special support bracket.
Figure 4:
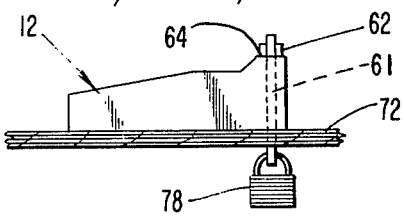
FIG. 4 is a side view of the security case of FIG. 3 mounted on and secured to a table top.

Referring to FIGS. 3–5, another embodiment of the invention is shown, wherein the back plate is modified as shown by 61, with a member 62 formed along an upper portion of the back plate to function both as a handle and as a stop member. The stop function of member 62 is caused by contact between the lower surfaces of the stop and the upper surface 64 of the flange 34, as shown in FIGS. 4 and 5, when the back plate is inserted through guide slots 38 and 48 of case 12. An elongate tab 66 is formed along the lower edge 68 of the back plate 61 and extends through the slot 48 formed in bottom wall 16 of the casing and through a corresponding, third slot 70 formed in a table top 72 or other stationary member.

With the back plate 61 inserted fully into upper guide slot 38 and through lower guide slot 48 in case 12, the lower edge 68 of the back plate is located in contact with the inner surface of bottom wall 16. Cut out portion 74 of back plate 61 is positioned to exposed the power terminals 58 of the computer 24. An aperture 76 formed in the elongate tab 66 extends beneath the table top 72 and is adapted to receive a padlock 78 (FIG. 4) or other locking device. Alternatively, as shown in FIG. 5, the case 12 may be mounted on an inclined bracket 80 having a slot (not shown) formed therein for receiving the tab 66.

Figure 6:
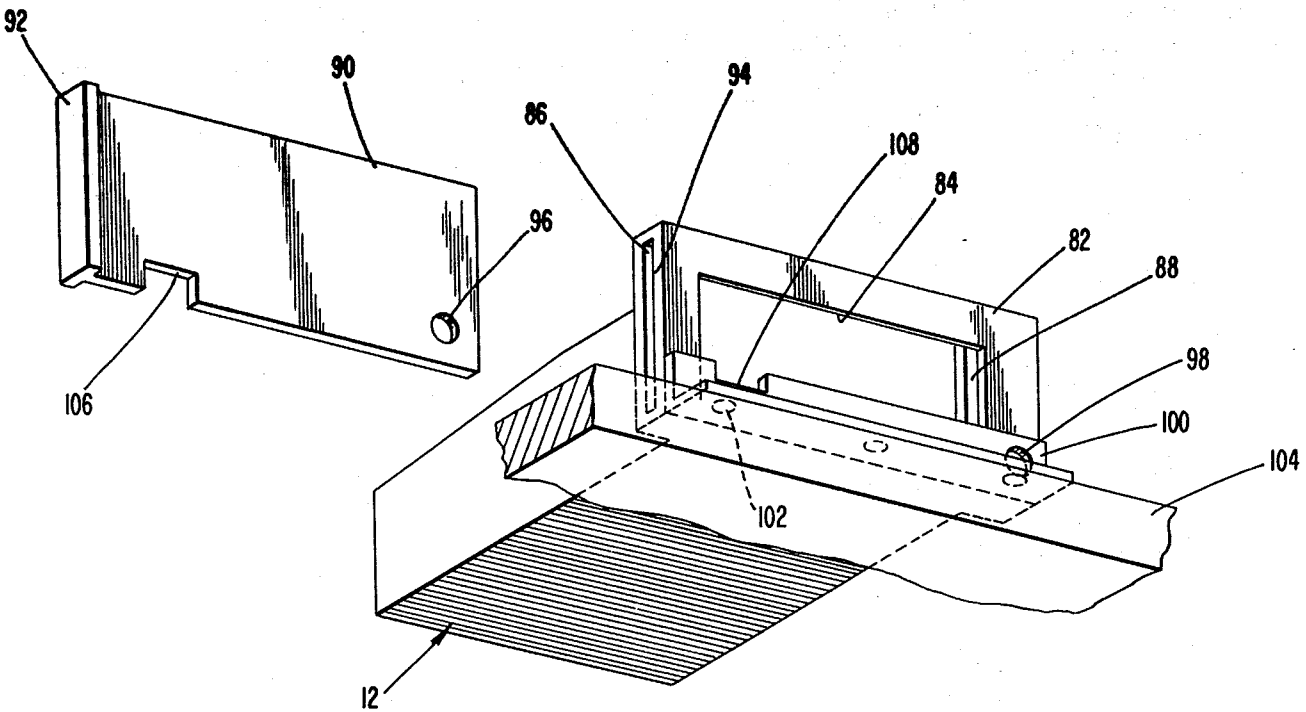
FIG. 6 is a perspective view showing another embodiment of the invention.

Referring now to FIG. 6, another embodiment of the invention is shown, wherein the rear of the security case 12 has attached thereto a back member 82. The back member 82 has formed therein a rectangular opening 84 for providing access to the inside of the case 12 by computer 24. Slots 86 and 88 are formed in opposite sides of the member 82 to receive a rectangular back plate 90, which is inserted into the member 82 from one side, as shown.

One edge of the back plate 90 has formed thereon a vertical member 92 which is similar to member 62 in FIG. 3 and functions both as a handle and as a stop. The stop 92 is located against side edge 94 of back member 82 when the back plate 90 is fully inserted in the member 82 to cover opening 84. An aperture 96 formed in the back plate 90 is in alignment with an aperture 98 formed in member 82 and extending through an angle bracket 100. The angle bracket 100, which is bonded to the rear surface of member 82, contains a series of holes 102 that are optionally used to fasten the back member 82 and casing 12 to a table top 104 by bolts (not shown).

A cut out portion 106 formed in the back plate 90 exposes the power terminals 58 (FIG. 2) of computer 24. A corresponding cut out 108 is also formed on bracket 100. With the back plate 90 fully inserted within back member 82, a locking member 52 of the type shown in FIG. 1 is inserted through the apertures 96 and 98 to secure the back plate 90. Thus, where the locking member 52 is secured to a hold-down cable 54 as in FIG. 1, the assembly 52, 54 will both secure the back plate 90 within case 12 and retain case 12 on the table top 104 but will permit movement within the radius of the cable 54.

Alternatively, if the angle bracket 100 is secured to the table top 104 by means of bolts, the back plate 90 may be secured within back member 92 by passing a padlock such as the one identified by 78 in FIGS. 4 and 5 through the apertures 96 and 98.

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. An apparatus for securing a portable appliance against theft, comprising: a case having a configuration corresponding to the configuration of said appliance and being defined by front, top, bottom and opposite side walls, said case having an open back to enable entry therethrough of said appliance; a removeable back plate adapted to cover the back opening of said case and thereby retain said appliance therein; one of said walls containing a first slot in a rear portion thereof for receiving said back plate therethrough; and means for releasably locking said back plate to said case.

2. The apparatus of claim 1, wherein said top wall has an opening formed therein to expose a portion of said appliance.

3. The apparatus of claim 2, wherein the opening formed in said top wall has a size and location to expose a keyboard on said appliance.

4. The apparatus of claim 1, wherein said first slot is formed adjacent said back opening of said case.

5. The apparatus of claim 1, wherein the wall opposite said one wall has a second slot formed therein, said back plate extending through both of said slots to cover the back opening.

6. The apparatus of claim 5, wherein said back plate has a tab formed along one side thereof, said tab being adapted to extend through said second slot.

7. The apparatus of claim 6, wherein said tab has an aperture formed therein, said locking means including a lock member for extending through said aperture to secure said back plate to said case.

8. The apparatus of claim 7, including a stationary member upon which said case is mounted, said stationary member containing a third slot corresponding to said second slot, said tab extending through said second and third slots, said lock member thereby securing said back plate and case to said stationary member.

9. The apparatus of claim 8, wherein said first slot is formed in the top wall and said second slot is formed in the bottom wall, said tab extending downwardly through the third slot formed in said stationary member.

10. The apparatus of claim 5, wherein the first and second slots are formed respectively in opposite side walls of said case.

11. The apparatus of claim 5, wherein a first aperture is formed in said back plate and a corresponding, second aperture is formed in said case, and said locking means includes a lock member releasably secured to said back plate and case through said apertures.

12. The apparatus of claim 1, wherein said back plate contains a cut out portion to expose an electrical terminal means of said appliance.

13. The apparatus of claim 11, wherein an outwardly extending flange is formed on said cause, said first aperture being located within said flange.

14. The apparatus of claim 1, including a hold down cable, one end thereof being attached to a stationary object and the opposite end being secured to said locking means.

15. An apparatus for securing a portable appliance against theft, comprising a case having an open back through which said appliance is inserted or removed; a back plate; guide means formed in said case for removeably retaining said back plate to enclose the back of said case; a hold down cable, one end thereof being attached to a stationary object; and means for releasably securing the opposite end of said cable to said back plate.

16. The apparatus of claim 15, wherein said releasably securing means includes a locking means passing through both of said case and said back plate to simultaneously secure said back plate and said case together and said case to said cable.

17. The apparatus of claim 15, wherein opposite walls of said case have slots formed therein to receive said back plate.

18. The apparatus of claim 17, wherein a top wall of said case has a first slot formed therein and a bottom wall of said case has a second slot formed therein, and a lower edge of said back plate is formed as a tab having a width that is substantially smaller than the width of said back plate, said second slot having a width corresponding to the width of said tab.

19. The apparatus of claim 18 , wherein the lower edge of said back plate further is formed with a cut out portion adapted to expose electrical terminal means on said appliance.

* * * * *